US008662356B2

(12) United States Patent
Padain et al.

(10) Patent No.: US 8,662,356 B2
(45) Date of Patent: Mar. 4, 2014

(54) DISPENSER AND REFILL UNIT

(75) Inventors: Christopher Leonard Padain, Montvale, NJ (US); Jacobus Simon Petrus Van Diepen, Heidelberg (DE); Xianzhi Zhou, Guangzhou (CN); Dong Xiao You, Dongguan (CN)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 114 days.

(21) Appl. No.: 13/129,164

(22) PCT Filed: Nov. 17, 2009

(86) PCT No.: PCT/GB2009/002682

§ 371 (c)(1),
(2), (4) Date: Sep. 12, 2011

(87) PCT Pub. No.: WO2010/055314

PCT Pub. Date: May 20, 2010

(65) Prior Publication Data

US 2012/0097711 A1 Apr. 26, 2012

(30) Foreign Application Priority Data

Nov. 17, 2008 (GB) ..... 0820981.9

(51) Int. Cl.
*G01F 11/00* (2006.01)

(52) U.S. Cl.
USPC ..... 222/325; 222/52; 222/183; 222/185.1; 222/481.5; 222/496; 222/511

(58) Field of Classification Search
USPC ..... 222/52, 63, 105, 183, 325, 333, 372, 222/504, 380, 481.5, 185.1, 496, 541.6, 222/511, 153.06
See application file for complete search history.

(56) References Cited

U.S. PATENT DOCUMENTS

| | | | | |
|---|---|---|---|---|
| 5,031,676 | A * | 7/1991 | Ulm | 141/346 |
| 5,232,125 | A * | 8/1993 | Adams | 222/83.5 |
| 5,273,083 | A * | 12/1993 | Burrows | 141/18 |
| 5,556,005 | A * | 9/1996 | Banks | 222/96 |
| 6,269,837 | B1 * | 8/2001 | Arent et al. | 137/614.04 |
| 6,386,403 | B2 * | 5/2002 | Parsons et al. | 222/399 |

FOREIGN PATENT DOCUMENTS

GB 2449469 A * 11/2008 ..... B67D 5/02

* cited by examiner

*Primary Examiner* — Frederick C Nicolas
(74) *Attorney, Agent, or Firm* — Troutman Sanders LLP; Ryan A. Schneider

(57) ABSTRACT

A dispenser including a base unit with an actuation mechanism for dispensing liquid and a refill unit insertible into the base unit in an inverted configuration with its outlet lowermost for the supply of liquid to the base unit. The refill unit includes an annular wall projecting into the refill unit and defining an outlet from the refill unit, the annular wall being closable at its innermost end by a valve element biased onto the annular wall. The base unit includes a hollow spigot and an annular seal surrounding and spaced from the top of the spigot whereby insertion of the refill unit into the base unit causes the spigot to enter the annular wall and to lift the valve element from the annular wall to define a flow path from the refill unit, and the annular seal to seal between the spigot and the annular wall.

20 Claims, 14 Drawing Sheets

DISPENSER AND REFILL UNIT

CROSS-REFERENCE TO RELATED APPLICATIONS

This application is a US National Stage of International Application No. PCT/GB2009/002682, filed 17 Nov. 2009, which claims the benefit of GB 0820981.9, filed 17 Nov. 2008, both herein fully incorporated by reference.

FIELD OF THE INVENTION

The present invention relates to a dispenser for dispensing a liquid soap or the like.

BRIEF SUMMARY OF THE INVENTION

The dispenser has a base unit into which a refill unit containing the material to be dispensed is fitted in an inverted configuration, namely with its outlet at the lowermost end. The present invention has been specifically designed for a free-standing soap dispenser suitable for use in a domestic environment. However, it could also be applicable to a wall-mounted unit and could be used for larger scale devices such as public lavatories. The unit may have a manually operated pump to dispense the liquid, but is preferably provided with a proximity sensor which senses the presence of the user's hand and has a pump to automatically dispense liquid.

As the device is primarily intended for the domestic market, it is essential that a consumer can replace a refill unit in a manner which is very easy, foolproof and without mess which is at best an annoyance for the consumer and at worst could destroy the dispensing mechanism.

According to the present invention, a dispenser comprises a base unit with an actuation mechanism for dispensing liquid and a refill unit insertable into the base unit in an inverted configuration with its outlet lowermost for the supply of liquid to the base unit, the refill unit comprising an annular wall projecting into the refill unit and defining an outlet from the refill unit, the annular wall being closable at its innermost end by a valve element biased onto the annular wall, the base unit comprising a hollow spigot and an annular seal surrounding and spaced from the top of the spigot, whereby insertion of the refill unit into the base unit causes the spigot to enter the annular wall and to lift the valve element from the annular wall to define a flow path from the refill unit, through at least one cut-out portion formed in the top of the spigot and/or the bottom of the valve element and down the hollow spigot, and the annular seal to seal between the spigot and the annular wall.

Such an arrangement provides a mechanism by which the refill unit can simply be lowered onto the spigot. This causes the flow path to be opened up. During the opening process, the annular seal forms a seal with the annular wall thereby preventing leakage even during the opening process.

The present invention therefore provides a simple and mess free way of replacing the refill unit even when the refill has not been completely emptied.

The cut-out portion could be formed in the bottom of the valve element. However, this would also require the valve seat to be shaped to match the cut-out portion on the valve element. It is therefore preferable for the cut-out portion to be on the top of the spigot. Preferably, there is more than one cut-out portion to provide a plurality of flow paths. In the preferred example, the cut-out portions effectively take the form of castellations on the top of the spigot.

The valve element could be biased by a spring which is on the opposite side of the valve element from the annular wall. However, preferably, the valve element is biased by at least one resilient member which is preferably joined at one end to the valve element and at the other end at a location radially outwardly of and below the innermost end of the annular wall, the or each resilient member being configured so that when the valve element is lifted from the annular wall, a flow path is present between the valve element and the annular wall.

By using at least one resilient member anchored outside of the annular wall, the structure of the device can be greatly simplified as the resilient elements themselves and the means by which they are anchored can be integrated into the existing structure of the refill unit. If the valve element was to be resiliently supported on its opposite side, then an additional structure would be required to support this, thereby complicating the design.

This forms an independent aspect of the present invention which can be defined in its broadest sense as a refill unit for a dispenser, the unit comprising an opening at one end which, in use, is the lowermost end, the opening comprising an annular wall projecting into the unit and being closable at its innermost end by a valve element biased onto the annular wall, wherein the valve element is biased by at least one resilient member with joined at one end to the valve element and at the other end to a location radially outwardly of and below the innermost end of the annular wall, the or each resilient member being configured so that, when the valve element is lifted from the annular wall, a flow path is present between the valve element and the annular wall.

If only a single biasing element is used, it could not be a continuous annular component, but would have to have holes in or be a helical structure, or similar, so that the flow path could be present. Preferably, there are a plurality of resilient elements with gaps therebetween to provide the flow path.

The or each resilient member may be manufactured separately from the valve element and fixed together. However, preferably, the valve element is manufactured integrally with the or each resilient member.

The or each resilient member preferably extends into a surrounding valve plate which is secured to the cap of the refill unit.

The valve plate may simply be glued, adhered or otherwise fixed within the cap. However, preferably, the valve plate is sandwiched between the cap and a fixing plate which may snap into place. Preferably, one or more fixing posts are provided in one of the cap, valve plate or fixing plate in order to locate the various elements with respect to one another.

The opening in the refill unit may be a liquid outlet or an air relief inlet. The structure of the annular wall, valve element and resilient member is equally applicable to either.

BRIEF DESCRIPTION OF THE DRAWINGS

A dispenser and refill unit in accordance with the present invention will now be described with reference to the accompanying drawings, in which.

DETAILED DESCRIPTION OF PREFERRED EMBODIMENTS

Figure 1:
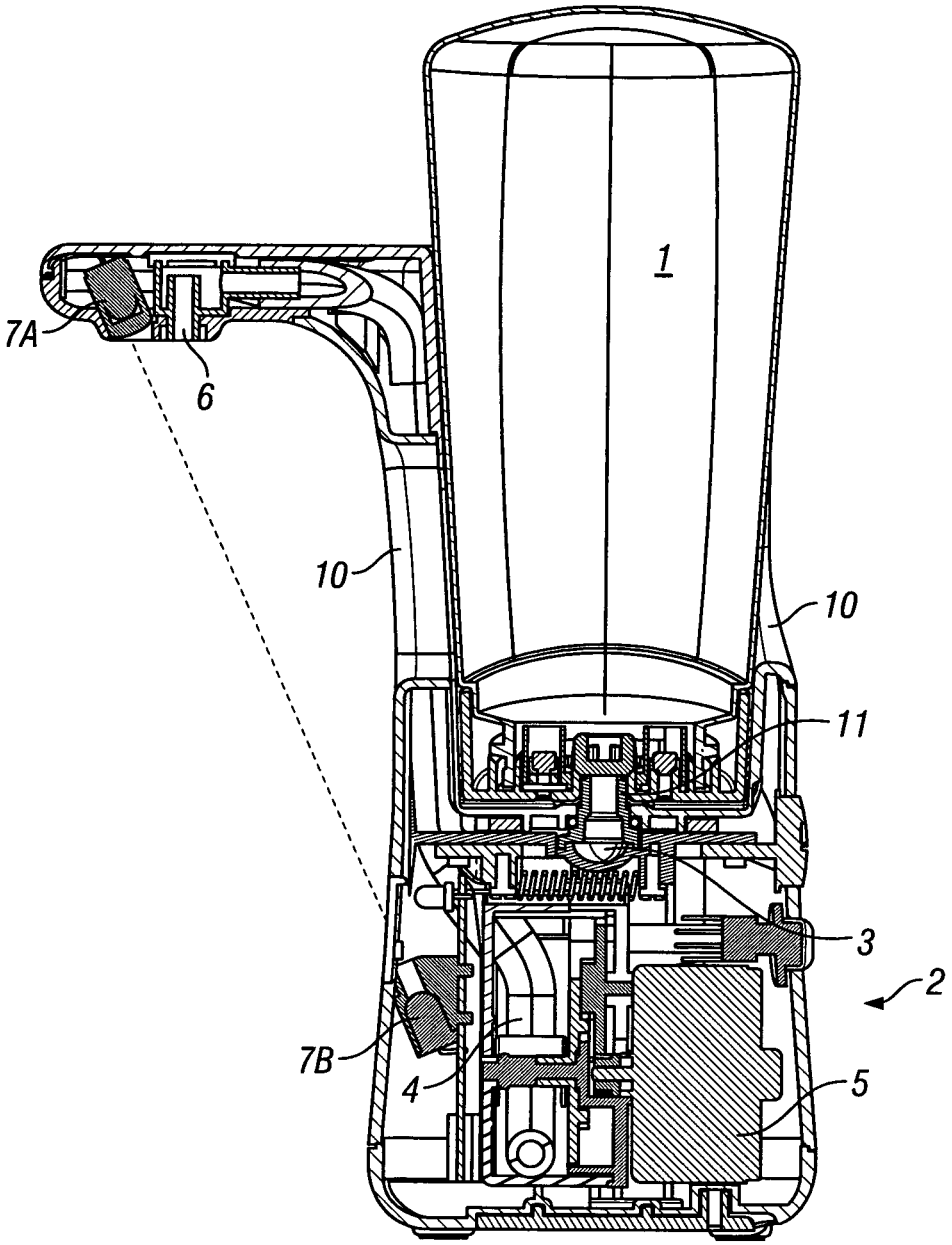
FIG. 1 is a cross-section through a dispenser.

The dispenser is a hands-free dispenser which is generally suitable for domestic use. The dispenser is primarily intended to dispense liquid soap, but may also be used to dispense other liquid or semi-liquid products (ideally with a viscosity greater than water), such as hand cream, body lotion, moisturiser, face cream, shampoo, shower gel, foaming hand wash, shaving cream, washing up liquid, toothpaste, acne treatment cream, a surface cleaner or a sanitising agent such as alcohol gel.

The dispenser comprises two main parts, namely a refill 1 and a base unit 2. The refill 1 provides a reservoir of liquid to be dispensed and is fitted to the base unit 2 as set out below.

The base has an interface 3 into which liquid is dispensed from the refill unit. The interface 3 is in fluid communication with a dispensing tube 4. A pump 5 is selectively operable to pump a metered dose of the liquid along dispensing tube 4 and out of dispensing head 6.

The base has an infrared transmitter 7A which transmits an infrared beam through a window 8 to a receiver 7B to sense the presence of a user's hands in the vicinity of the dispenser. Control circuitry reacts to a signal from the proximity sensor to activate the pump. The illustrated sensor is a break beam sensor, but may also be a reflective sensor. Although an infrared sensor is shown, any known proximity sensor such as a capacitive sensor may be used. The device may be mains powered or battery powered. Alternatively, it may be a manually operated pump device in which a user pushes a lever to displace the product.

The interface between the refill 1 and base unit 2 will now be described in greater detail with reference to FIGS. 2 to 10.

The base unit 2 comprises a cowling 10 which forms a cup-shaped housing surrounding a significant portion of the refill to protect and support it. A spigot 11 projects through the base of the cowling 10 and is sealed to the cowling 10 by an O-ring seal 12. The spigot has a plurality of castellations 13 in its top surface. A second O-ring seal 14 surrounds the spigot 11 beneath the castellations 13.

The refill 1 comprises a bottle 20 to which a cap 21 is fixed. The bottle 20 has a neck 22 which fits over and seals with an annular flange 23 within the cap 21. The cap 21 has an upwardly depending skirt 24 (when in the inverted orientation shown in the drawings) which forms the outer surface of the cap. Working inwardly from the skirt 24, the next feature of the cap is an outer annular wall 25 which is generally co-axial with the skirt 24.

This is shown in detail in FIGS. 5 to 10.

Figure 2:
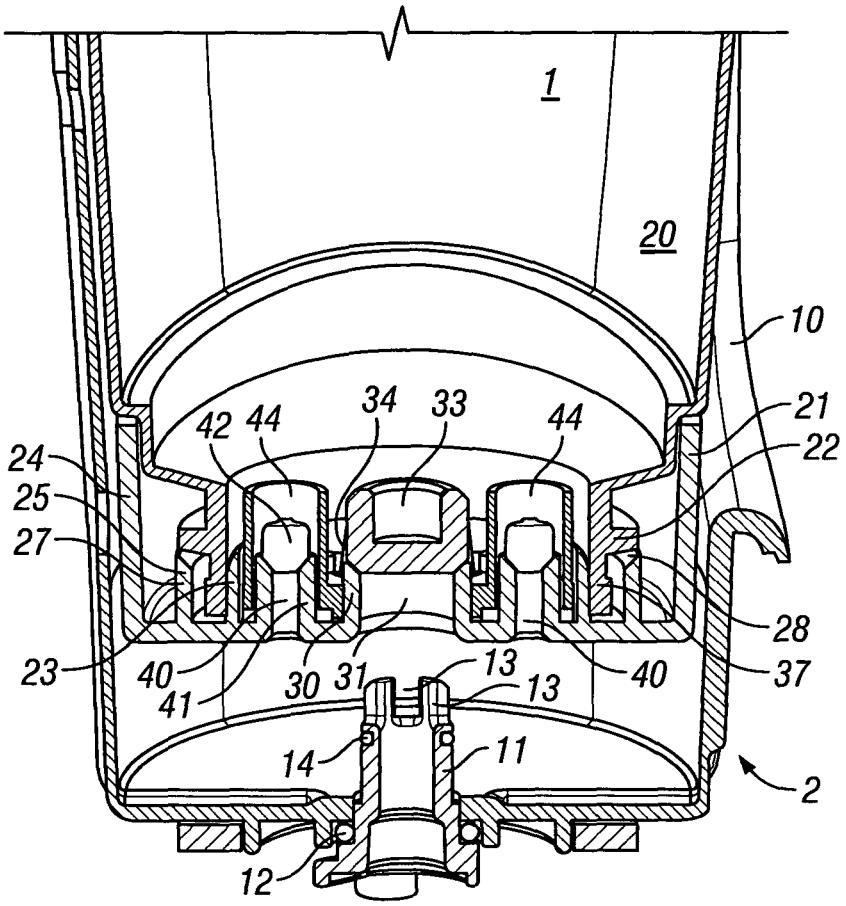
FIG. 2 is a cut-away perspective view of the refill being introduced into the dispenser but not yet being engaged.
Figure 5:
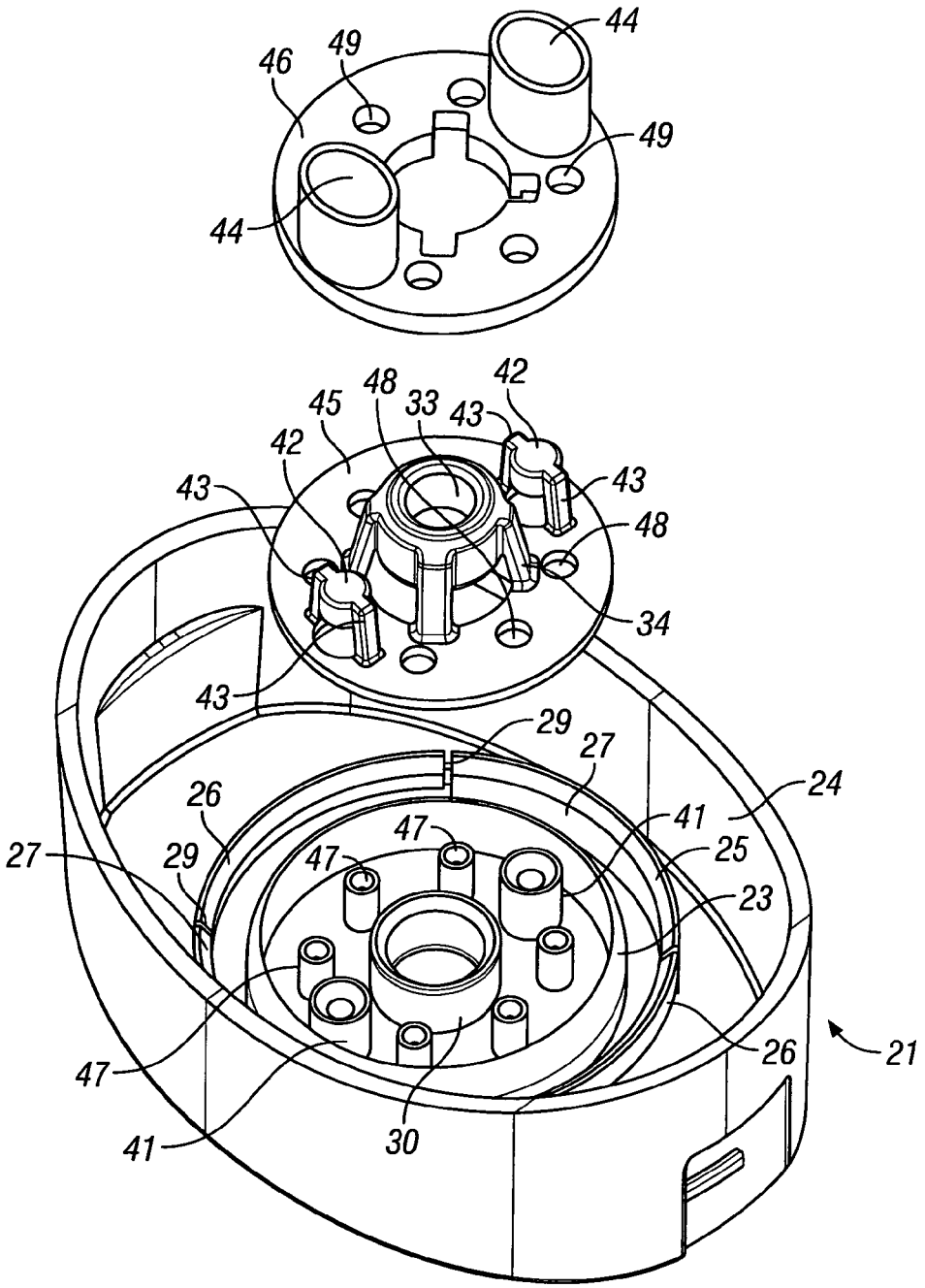
FIG. 5 is a perspective view of the cap assembly prior to assembly.
Figure 6:
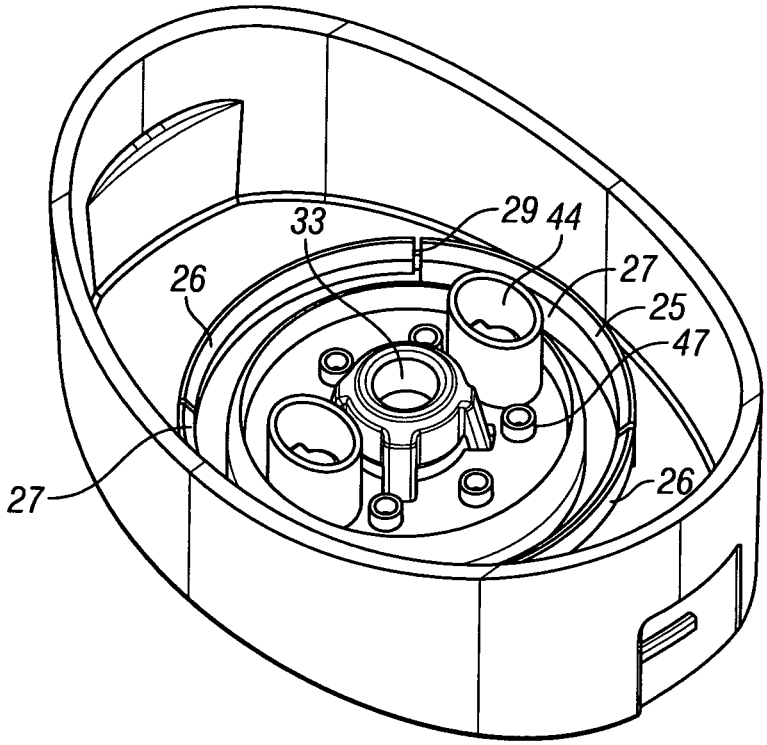
FIG. 6 is a perspective view of the cap assembly after assembly.
Figure 7:
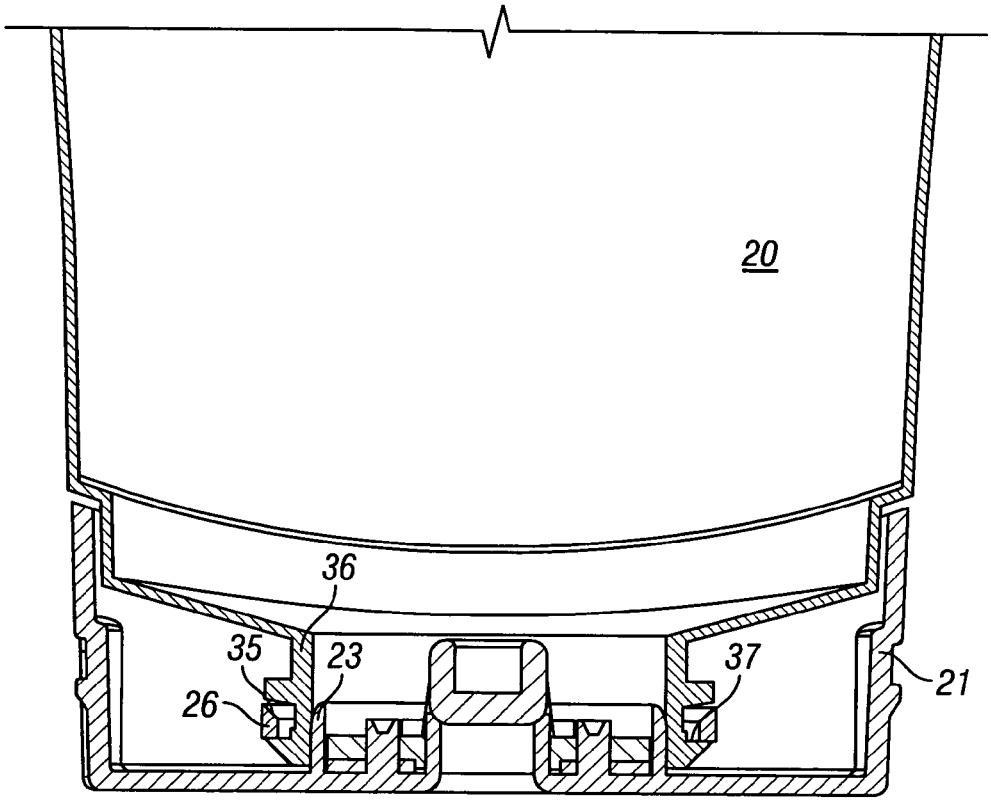
FIG. 7 is a cross-section showing the engagement between the bottle neck and cap assembly.
Figure 8:
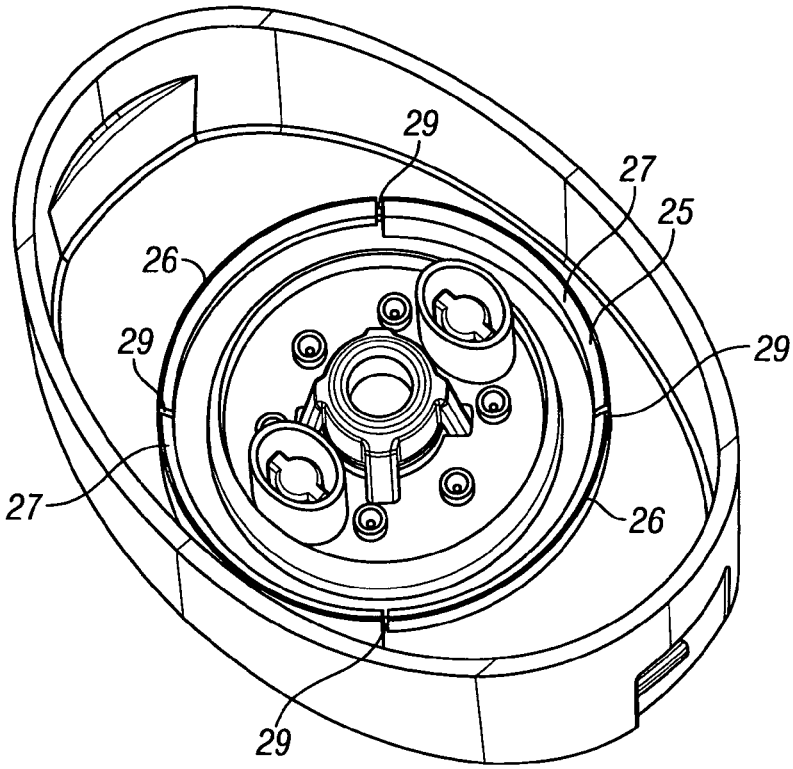
FIG. 8 is a perspective view of the cap with the frangible members intact.
Figure 9:
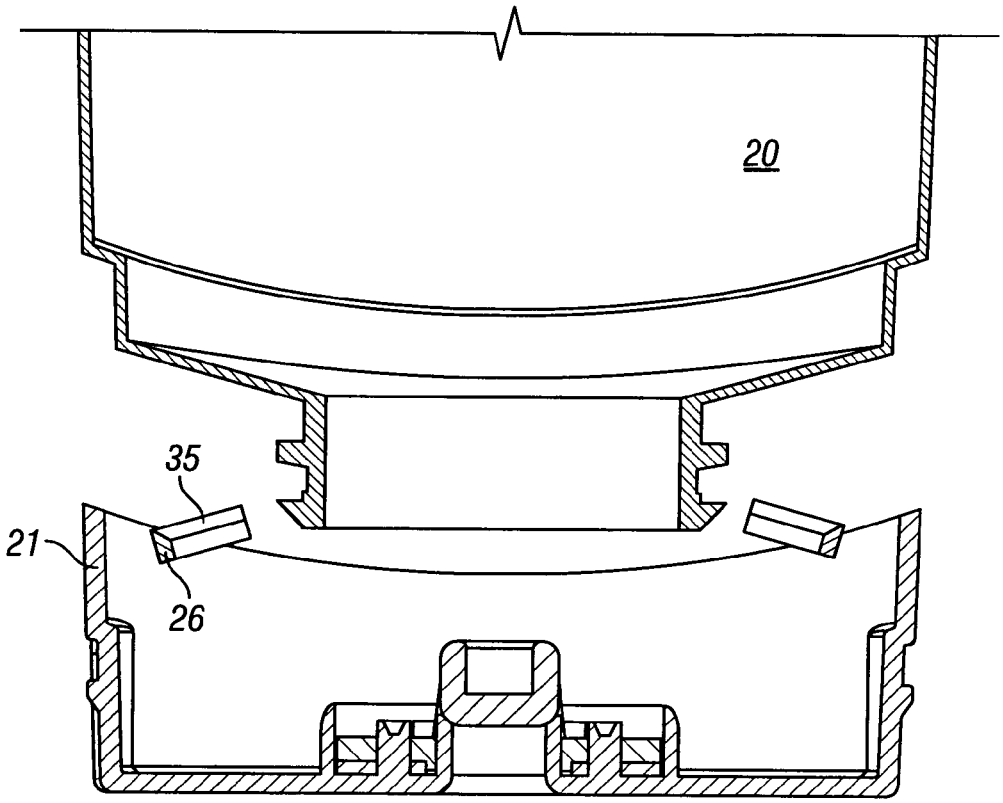
FIG. 9 is a view similar to FIG. 7 after the bottle has been removed from the cap.

The outer annular wall 25 consists of a pair of retaining members 26 and a pair of support members 27 which alternate with one another and each extend for approximately a quarter of the circle as shown in FIGS. 5, 6, 8 and 10. The profile of the support members 27 is as shown in FIG. 2. These members extend directly up from the lower wall of the cap, are parallel sided and have an inclined upper surface 28. The profile of the retaining members 26 is shown in FIGS. 7 and 9. Unlike the support members 27, these are not fixed to the wall of the cap. Instead, they are fixed at either end to the support members 27 by frangible members 29 as best shown in FIGS. 6 and 8. The retaining members 26 are parallel sided and have an inclined upper surface 35 as shown in FIGS. 7 and 9.

As shown in FIGS. 7 and 9, the neck 22 of the bottle has an inclined outer surface 36 which is complimentary to the inclined surfaces 28 and 35 of the annular wall 25. Behind the inclined outer surface 36 is a shoulder 37 which faces the main body of the bottle 20. This inclined outer surface 36 and shoulder 37 is only present in the vicinity of the retaining members 26 and not in the vicinity of the support members 27. Adjacent to the support members 27, the neck 22 has a parallel sided configuration as shown in FIG. 2.

Figure 10:
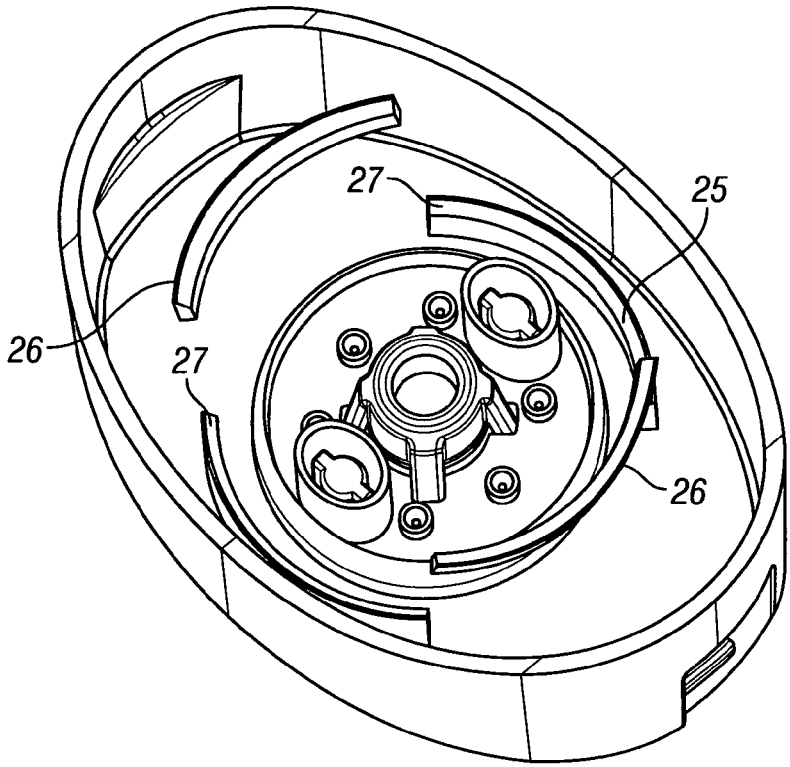
FIG. 10 is a view similar to FIG. 8 after the frangible members have broken off.

In order to insert the bottle 20 into the cap 21, the bottle 20 is pushed down with its neck fitting over the annular flange 23. The inclined outer surface 36 of the bottle co-operates with the inclined surfaces 28, 35 to displace the retaining members 26 radially outwardly until the shoulder 37 snaps into place behind the retaining members 26 as shown in FIG. 7. When the bottle 20 is pulled off of the cap 21, the shoulders 37 bear against the retaining members 26, thereby breaking frangible members 29 so that the retaining members 26 become detached from the cap 21 as shown in FIGS. 9 and 10. Once this has happened, it is no longer possible to retain the cap on a bottle, thereby preventing subsequent use of the refill 1.

It should be noted that it is not necessary for both of the retaining members 26 to become fully detached from the lid. It is possible that only one of these becomes detached, or that one or both are simply displaced to a location at which they can no longer engage with the neck of the bottle.

Returning now to FIGS. 2 to 4, the liquid outlet and associated valve will now be described.

The liquid outlet from the reservoir is provided by an annular wall 30 surrounding a central opening 31. At the top of the annular wall 30 is an inclined surface 32 (see FIG. 4) which provides a valve seat for outlet valve element 33. This is shown in the form of a U-shape cup-like member, but may equally be a solid member or a hollow ball-like member. The outlet valve element 33 is biased into its closed position by a plurality of biasing elements 34. These are attached at their upper end towards the top of the valve element 33 and are attached at their lower ends at a location radially outward of the annular wall 30 and below the top of the annular wall 30. They are preferably formed integrally with the valve element 33.

Figure 3:
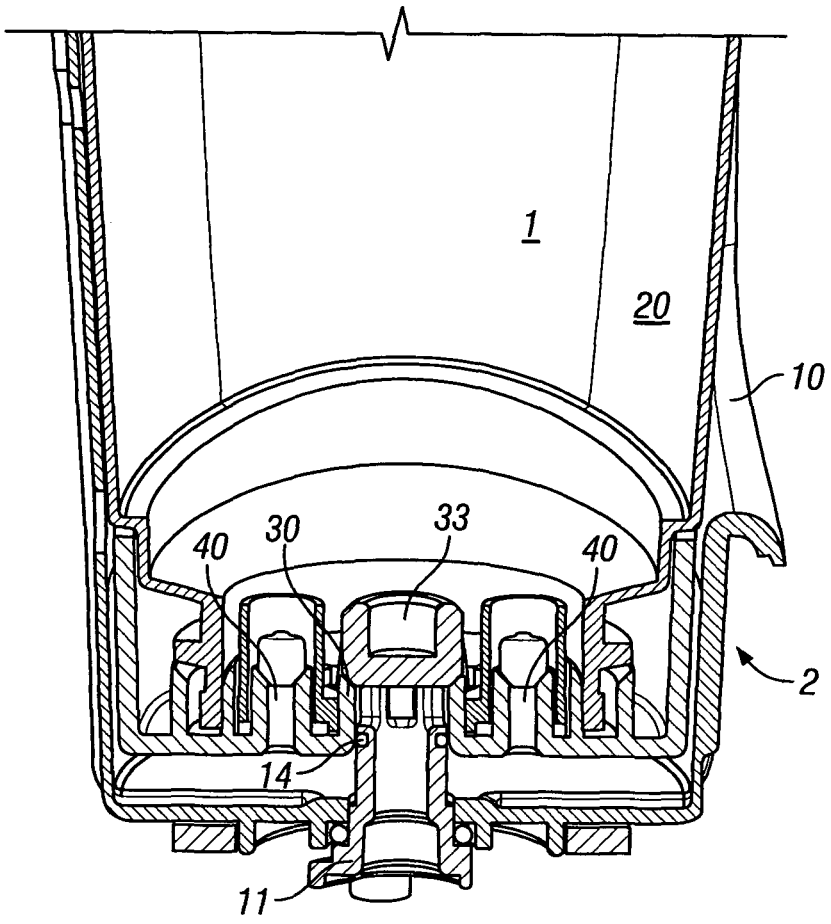
FIG. 3 is a view similar to FIG. 2 showing the refill in an intermediate position.
Figure 4:
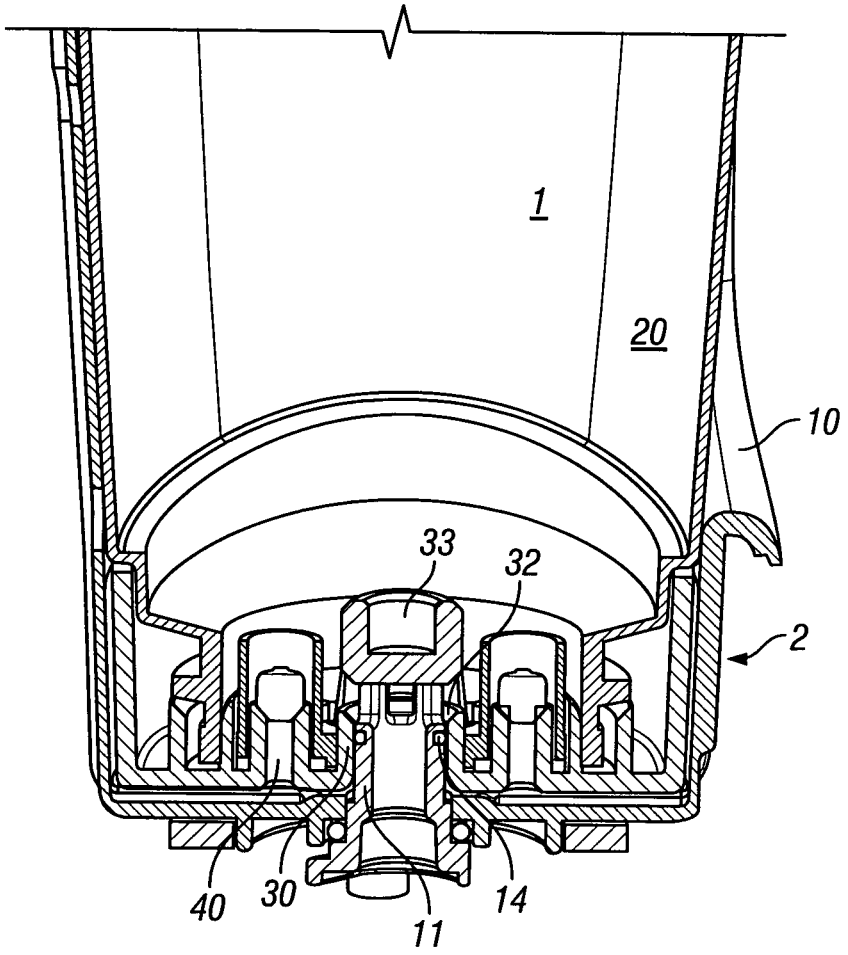
FIG. 4 is a view similar to FIGS. 3 and 4 showing the refill in its fully engaged position.

As shown in FIGS. 2 to 4, when the refill 1 is lowered into the base unit 2, the spigot 11 engages with the lower surface of the valve element 33 as shown in FIG. 3. Further downward movement of the refill causes the valve element 33 to be lifted from its seat, and also brings the O-ring 14 into sealing engagement with the annular wall 30. The valve element 33 is lifted to the position shown in FIG. 4. In this position, liquid in the bottle 20 can flow around the biasing elements 34, and enter the spigot via the castellations 13 and hence flow into the base unit 2. Liquid is prevented from escaping between the spigot 11 and annular wall 30 by the O-ring seal 14. This arrangement offers a simple and mess-free way for a consumer to insert a refill regardless of the fill level of the refill.

In order to remove a refill, the consumer lifts it out of the base whereupon the biasing elements 34 cause the valve element 33 to return to the seat 32. During this movement, the seal between the spigot 11 and annular wall 30 is maintained by the O-ring seal 14. A spent refill is then replaced by a new one following the above procedure.

The cap is provided with a pair of pressure relief valves 40. Each is formed by an annular boss 41 integral with the cap 21. A pressure relief valve element 42 is seated on the top of the annular boss 41 and is biased in place by a pair of biasing elements 43 (as shown, for example, in FIG. 5). The biasing force is such that, under normal conditions, the pressure relief valve element 42 forms an air tight seal on the boss 41. However, when the pressure within the bottle 20 drops below a certain level, the pressure differential across the relief valve element 42 is sufficient to overcome the force exerted by biasing elements 43 and to allow air into the bottle 20. This reduces the pressure differential thereby restoring the air tight seal without leakage of fluid.

Each pressure relief valve 40 is surrounded by an annular barrier 44 which extends axially to a level axially above the level of the top of the annular wall 30. Thus, when the valve element 33 is open, any air entering the relief valve 40 will not become entrained in the outgoing liquid stream. In practice, this means that the relief valve can be placed closer to the outlet, thereby resulting in a more compact cap. Although two relief valves are shown, a single valve, or more than two valves could be provided if necessary.

The manner in which the cap is assembled is illustrated in FIGS. 5 and 6.

The assembly is a three-part structure consisting of the cap 21, a valve plate 45 and a fixing plate 46. The cap has a number of moulded features including the annular flange 23, annular wall 25 and annular bosses 41. In addition, the cap 21 has a plurality of fixing posts 47.

The valve plate 45 is an elastomeric material and is integrally formed with the valve element 33, biasing elements 34, relief valve element 42 and biasing elements 43. The valve plate has a plurality of locating holes 48 which correspond to the fixing posts 47.

The fixing plate 46 is made of a rigid plastics material and is integrally formed with the annular barrier 44. As with the valve plate 45, the fixing plate 46 is also provided with a plurality of locating holes 49 which correspond to the fixing posts 47.

To assemble the cap, the three components are placed on top of one another as shown in FIG. 6 with the fixing posts entering the locating holes to ensure that the components are correctly aligned. Heat or adhesive is then applied to the top of the fixing posts 47 to secure the fixing posts to the fixing plate 46. The elastomeric valve plate 45 is thereby sandwiched between the cap 21 and fixing plate 46 which holds the valve elements 33 and 42 in position.

A second example of a cap for a refill unit will now be described with reference to FIGS. 11 to 14.

The structure of the outlet valve element 33 in the second example is essentially the same as the first example, and will not be described again in relation to the second example.

Figure 11:
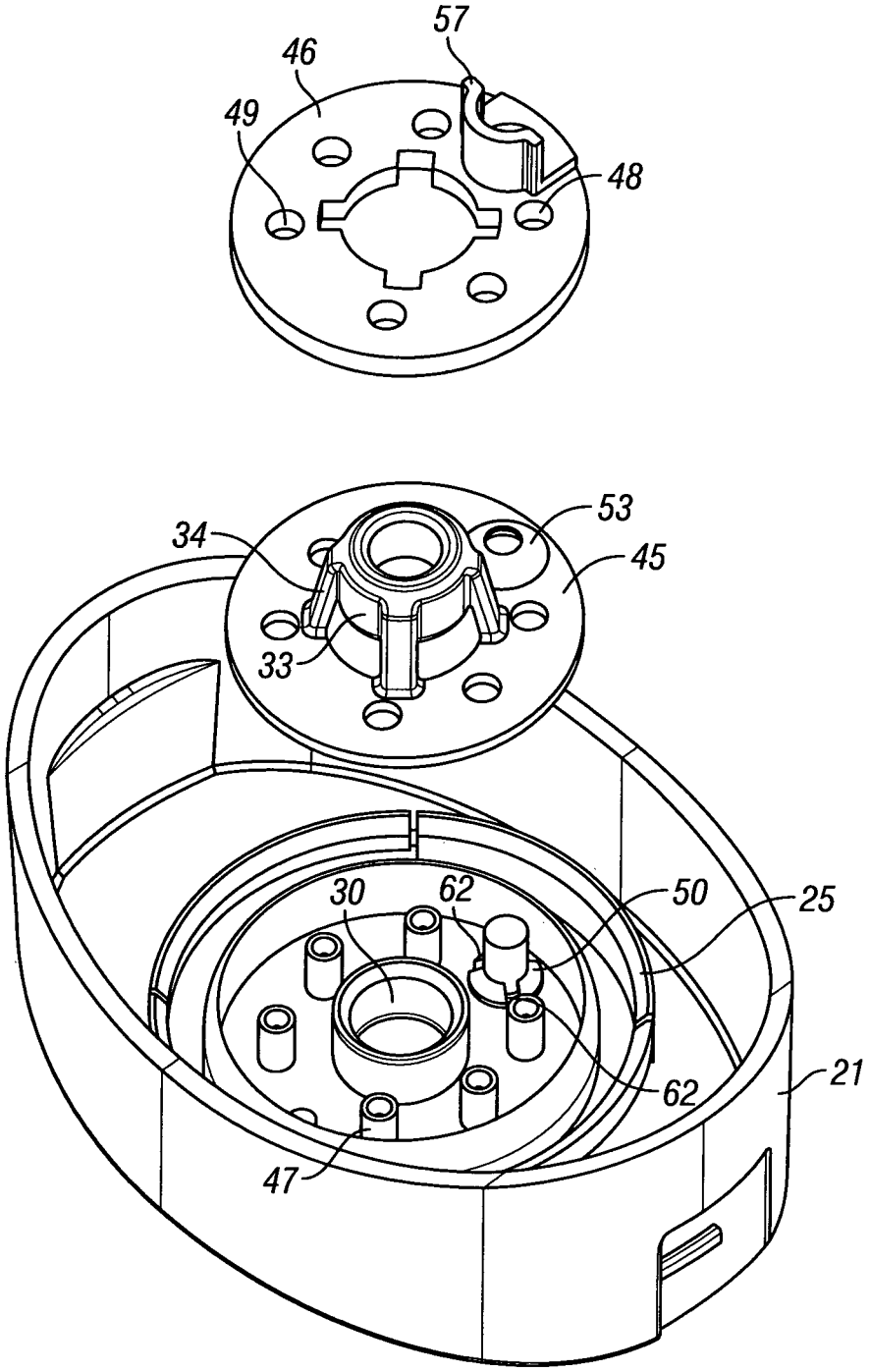
FIG. 11 is an exploded perspective view of a cap of a second refill unit.
Figure 12:
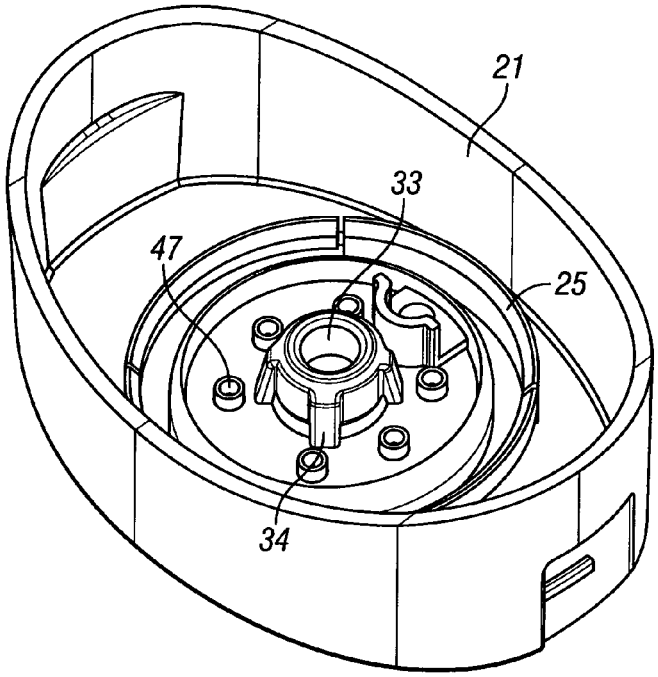
FIG. 12 is a view similar to FIG. 11 showing the assembled cap.

As can be seen from FIG. 11, the cap 21 is integrally molded with a number of features, such as the annular walls 25 and 30 and a conical part 50 of the pressure relief valve which will be described below. A resilient lip 53 (described in more detail below) for the pressure relief valve is provided integrally molded with the valve plate 45. The fixing plate 46 is also provided with a shield 57 for the relief valve. This is equivalent to the barrier 44 in FIG. 2, but only extends around the side of the relief valve facing the outlet valve element 33. The barrier 44 and shield 57 could be used interchangeably in the two examples.

The cap assembly is assembled in the same manner as in the first example.

Figure 13:
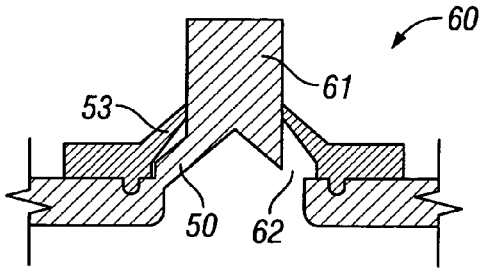
FIG. 13 is a cross-sectional view through the pressure relief valve of the second example.
Figure 14:
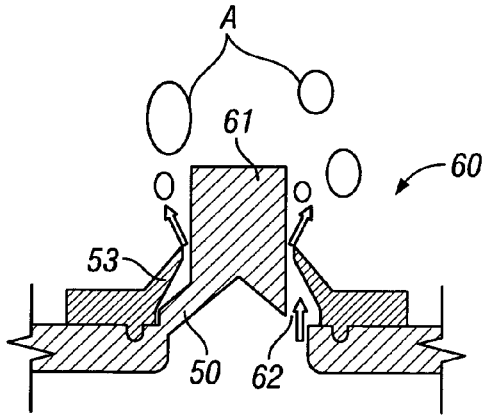
FIG. 14 is a view similar to FIG. 13 showing the pressure relief valve in an open configuration to allow the flow of air.

The pressure relief valve 60 is illustrated in FIGS. 13 and 14.

The valve has the conical part 50 which is an integral part of the cap 21 as mentioned above. At the top of the conical part 50 is a cylindrical post 61. The resilient lip 53 is effectively a hollow frustoconical extension of the valve plate 52 of resilient material which extends along the conical part 50 from which it diverges slightly and is a tight fit against the post 61. At least one air inlet 62 (also shown in FIG. 11) passes through the wall of the conical part 50 and is normally covered by the resilient lip 53 as shown in FIG. 11. When the pressure in the bottle 20 falls as liquid is emptied the pressure differential across the resilient lip 53 will eventually become sufficient to displace the lip 53 to a sufficient degree to allow air A into the bottle 20 as shown by the arrows in FIG. 8. It should be noted that the degree to which the resilient lip 53 lifts from the conical element 50 has been exaggerated in FIG. 8 and that, in practice, this will be almost imperceptible.

Instead of sealing against the post, the resilient lip 53 may seal against the conical part 50. In this case, the lip will not diverge from the conical part as shown. Instead, it would actually have an angle of incline less than the angle of the conical part 50 so as to be naturally biased onto the conical part.

An example of a third refill unit will now be described with reference to FIGS. 15 to 18. This is the same in most respects as the first example, and only the significant differences are described here.

Figure 15:
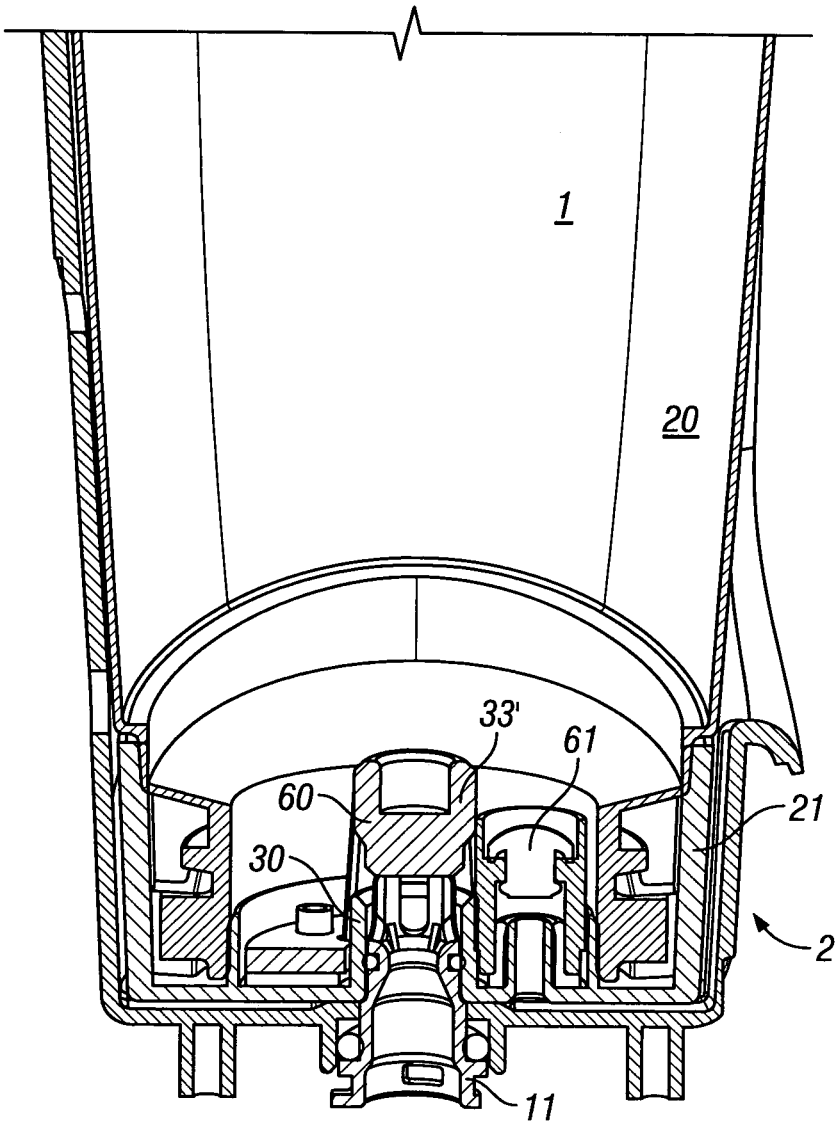
FIG. 15 is a view similar to FIG. 4 showing a third refill unit on the dispenser.

As can be seen in FIG. 15, the outlet valve element 33' is shaped differently. In this case, there is a reduced diameter portion 60 which fits within the annular wall 30 when the valve is closed to assist the sealing to the annular wall.

The pair of pressure relief valves 40 have been replaced by a single conventional umbrella valve 61.

Figure 16:
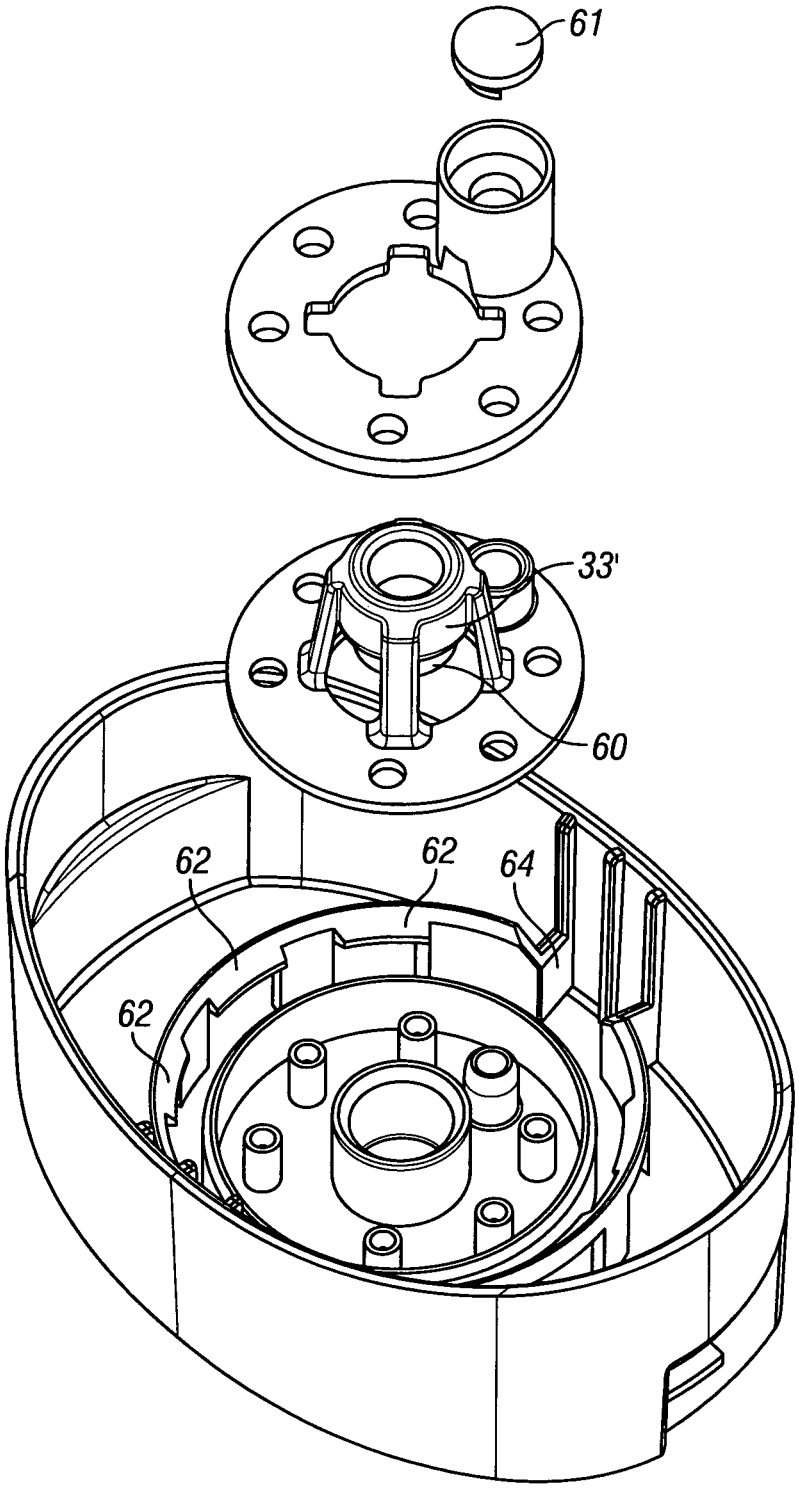
FIG. 16 is a view similar to FIG. 5 of the cap of the third refill unit.
Figure 17:
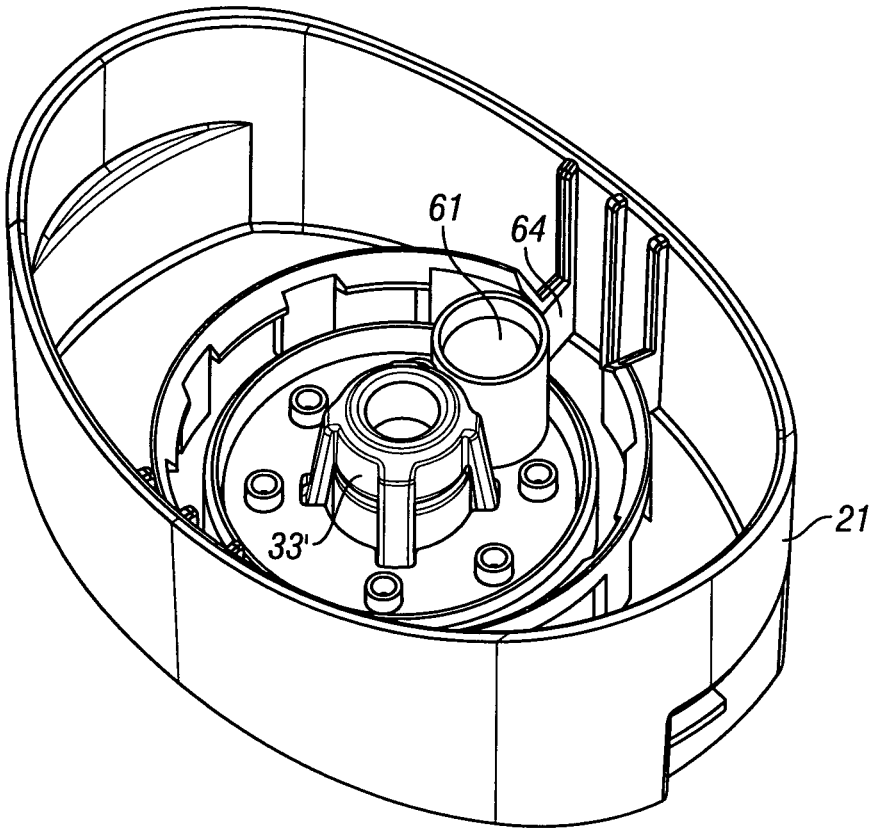
FIG. 17 is a view similar to FIG. 6 showing the cap of the third refill unit assembled.
Figure 18:
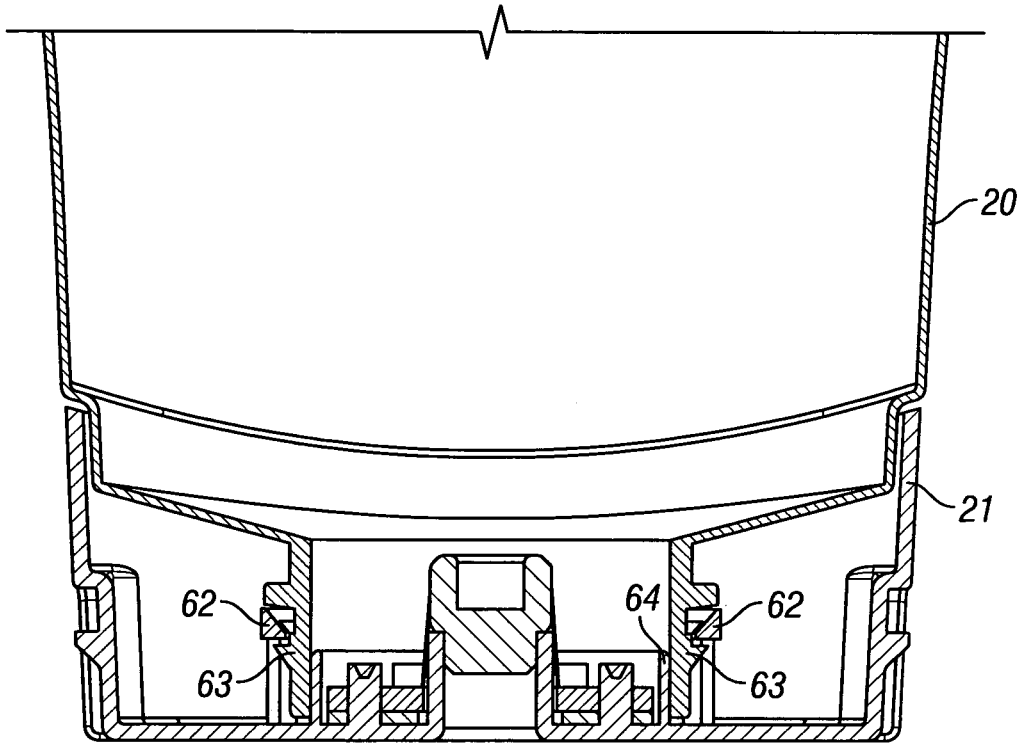
FIG. 18 is a view similar to FIG. 7 of the third refill unit.

The retaining members 26 with their frangible members 29 have been replaced by a plurality of intermittent shoulders 62 which, as shown in FIG. 18 engage with complementary shoulders 63 on the neck of the bottle 20. Inward deflection of the neck of the bottle is prevented by a flange 64. Once in the FIG. 18 position, the engagement between the shoulders is strong enough to prevent the cap from being removed from the bottle for all practical purposes. This is facilitated by a keying arrangement 64 on the cap as shown in FIGS. 16 and 17 which engages with a complementary protrusion on the bottle (not shown) to prevent relative rotation between the cap 21 and bottle 20.

The invention claimed is:

1. A dispenser comprising:

a base unit with an actuation mechanism for dispensing a liquid; and a refill unit containing the liquid to be dispensed, the refill unit comprising a bottle to which a cap is fixed, a liquid outlet through the cap provided by an annular wall projecting into the refill unit and surrounding a central opening, the liquid outlet being closable by an outlet valve element biased into a closed position onto the annular wall by at least one resilient member, wherein the outlet valve element is manufactured integrally with the at least one resilient member, and the at least one resilient member is integrally formed with a valve plate which is secured to the cap of the refill unit;

where upon the refill unit being inverted and inserted into the base unit to supply the liquid to be dispensed to the base unit, the liquid outlet is at a lowermost end of the refill unit;

the base unit comprising a hollow spigot whereby insertion of the refill unit into the base unit causes the spigot to enter the liquid outlet and to lift the outlet valve element from the annular wall to define a flow path from the refill unit to the base unit, through at least one castellation formed in the spigot.

2. A dispenser according to claim 1, wherein the at least one resilient member is joined at one end to the outlet valve element and at the other end at a location radially outwardly of and below the innermost end of the annular wall, the at least one resilient member being configured so that when the outlet valve element is lifted from the annular wall, a flow path is present between the outlet valve element and the annular wall.

3. A dispenser according to claim 1 comprising a plurality of resilient members with gaps therebetween to provide the flow path.

4. A dispenser according to claim 1, wherein the valve plate is sandwiched between the cap and a fixing plate.

5. A dispenser according to claim 4 further comprising one or more fixing posts provided in one of the cap, valve plate or fixing plate in order to locate the cap, valve plate and fixing plate with respect to one another.

6. A dispenser according to claim 1, wherein the liquid contained within the refill unit has a viscosity greater than water.

7. A refill unit for a dispenser, the unit comprising:

an opening at one end through a cap, the opening comprising an annular wall projecting into the unit and being closable at an innermost end of the annular wall by a valve element biased onto the annular wall;

wherein the valve element is biased by at least one resilient member joined at one end to the valve element and at another end to a location radially outwardly of and below the innermost end of the annular wall, the at least one resilient member being configured so that, when the valve element is lifted from the annular wall, a flow path is present between the valve element and the annular wall; and wherein the valve element is manufactured integrally with the at least one resilient member and the at least one resilient member extends into a valve plate which is secured to the cap.

8. A refill unit according to claim 7 further comprising a plurality of resilient elements with gaps therebetween to provide the flow path.

9. A refill unit according to claim 7, wherein the valve plate is sandwiched between the cap and a fixing plate.

10. A refill unit according to claim 9 further comprising one or more fixing posts provided in one of the cap, valve plate or fixing plate in order to locate the cap, valve plate and fixing plate with respect to one another.

11. A refill unit according to claim 7, wherein the opening is a liquid outlet and the valve element is a liquid outlet valve element.

12. A refill unit according to claim 7, wherein the opening is an air relief inlet and the valve element is an air relief valve element.

13. A refill unit according to claim 7 filled with a liquid having a viscosity greater than water.

14. A dispenser and refill unit comprising:

a base unit with an actuation mechanism for dispensing liquid; and a refill unit insertible into the base unit in an inverted configuration with the refill unit's outlet lowermost for a supply of liquid to the base unit;

wherein the refill unit comprises an annular wall projecting into the refill unit and defining an outlet from the refill unit, the annular wall being closable at an innermost end of the annular wall by a valve element biased onto the annular wall;

wherein the base unit comprises a hollow spigot and an annular seal surrounding and spaced from a top of the spigot whereby insertion of the refill unit into the base unit causes the spigot to enter the annular wall and to lift the valve element from the annular wall to define a flow path from the refill unit, through one or both of at least one cut-out portion formed in the top of the spigot and a bottom of the valve element and down the hollow spigot, and the annular seal to seal between the spigot and the annular wall; and wherein the at least one resilient member extends into a surrounding valve plate which is secured to a cap of the refill unit.

15. A dispenser and refill unit according to claim 14, wherein the valve element is biased onto the annular wall by at least one resilient member.

16. A dispenser and refill unit according to claim 14, wherein the valve plate is sandwiched between the cap and a fixing plate.

17. A dispenser and refill unit according to claim 15, wherein the at least one resilient member is joined at one end to the valve element and at the other end at a location radially outwardly of and below the innermost end of the annular wall, the at least one resilient member being configured so that when the valve element is lifted from the annular wall, a flow path is present between the valve element and the annular wall.

18. A dispenser and refill unit according to claim 15 further comprising a plurality of resilient elements with gaps therebetween to provide the flow path.

19. A dispenser and refill unit according to claim 15, wherein the valve element is manufactured integrally with the at least one resilient member.

20. A dispenser and refill unit according to claim 16 further comprising one or more fixing posts provided in one of the cap, valve plate or fixing plate in order to locate the cap, valve plate and fixing plate with respect to one another.

* * * * *